US005813269A

United States Patent [19]

Yano

[11] Patent Number: 5,813,269

[45] Date of Patent: Sep. 29, 1998

[54] DIE ASSEMBLY FOR EXTRUDING HOLLOW METALLIC ARTICLES

[75] Inventor: Sadahide Yano, Osaka, Japan

[73] Assignee: Yugen Kaisha Yano Engineering, Osaka, Japan

[21] Appl. No.: 771,262

[22] Filed: Dec. 20, 1996

[30] Foreign Application Priority Data

Dec. 22, 1995 [JP] Japan ..... 7-334437

[51] Int. Cl.[6] ..... B21C 23/02

[52] U.S. Cl. ..... 72/261; 72/269

[58] Field of Search ..... 72/261, 269, 272, 72/273.5

[56] References Cited

U.S. PATENT DOCUMENTS 4,080,816 3/1978 Ames et al. ..... 72/261

FOREIGN PATENT DOCUMENTS 0 558 288 A1 9/1993 European Pat. Off. .
0 659 496 A1 6/1995 European Pat. Off. .
0 718 052 A1 6/1996 European Pat. Off. .
55-106626 8/1980 Japan ..... 72/261
1-284423 11/1989 Japan ..... 72/269
6-91324 4/1994 Japan ..... 72/269
0 699 487 A1 3/1996 Japan .
2 286 354 8/1995 United Kingdom .

*Primary Examiner*—Joseph J. Hail, III
*Assistant Examiner*—Ed Tolan
*Attorney, Agent, or Firm*—Armstrong, Westerman, Hattori, McLeland & Naughton

[57] ABSTRACT

The object of the present invention is to provide a die assembly of a compact structure adapted for simultaneously extruding two or more hollow metallic articles of a high precision in size and shape. A male die 2 has two apertures 15 in a bridge 13 of a core holder 6 and two cores 5 respectively inserted in the aperture 15, and a female die 3 has two bearing edges 21 to contour an outer periphery of a hollow article 'E'. When the male die 2 combines with the female die 3, a plurality of forming slots 22 are independently formed in one die assembly.

3 Claims, 10 Drawing Sheets

DIE ASSEMBLY FOR EXTRUDING HOLLOW METALLIC ARTICLES

BACKGROUND OF INVENTION

1. Field of the Invention

The present invention relates to a die assembly for extruding a metal such as aluminum to form hollow articles.

2. Related Art

A die assembly 51 illustrated in FIGS. 10A and 10B is generally known as a die assembly for extruding a tubular element 'E', as shown in FIG. 8, constituting a heat exchanger. The die assembly 51 is a combination of a male die 52 and a female die 53. The male die 52 consists of a core 54 and a core holder 55 that is separable therefrom and fittable therein. When a bearing lug 56 of the end of the core 54 becomes abraded, only the core 54 can be replaced with a new one with the other parts being reused, so that the abraded die member can be exchanged economically. The numeral 57 denotes a bearing edge and the numeral 59 denotes a forming slot. Further, the numeral 60 denotes a core holding aperture penetrating the bridge 61 of the core holder 55.

Recently, simultaneously extrusion, by means of the so-called indirect extrusion, or the like, of a plurality of hollow articles 'E' of which high productivity is required is being developed. In detail, two (or more) combination die assemblies 51 of male and female dies shown in FIGS. 10A and 10B are prepared. The die assemblies 51 are held in a line at given spaces in a die case 62 shown in FIG. 11 and indirect extrusion is conducted thereby as shown in FIG. 9. Under these circumstances, simultaneous extrusion of two (or more) tubular elements 'E' is on its trial. The numerals 63, 64 and 65 respectively denote a container, a pressing stem and a die stem with the reference symbol 'B' denoting a billet.

However, since the die assembly of the above-mentioned conventional simultaneous extrusion of hollow articles has the structure that the plurality of die assemblies 51 are held in a line at given spaces in a die case 62 as shown in FIG. 11, the outer diameter of the whole die assembly including the die case 62 becomes extremely large. In the method of indirect extrusion, the whole die assembly 51 including the die case 62 moves inside a billet holding cavity 66 relative to the container 63. Accordingly, a large-sized custom-made container should be prepared, but it cannot be easily afforded because of the cost. Further, when the container 63 becomes larger, high extrusion pressure is required. These drawbacks greatly prevent the simultaneous extrusion from practical use.

Even in a case of direct extrusion, in the similar die structure that the die case 62 holds a plurality of die assemblies 51, a container having a large billet holding cavity is required. Thus, the same problems as above are likely to happen.

In addition, in the structure that a plurality of die assemblies 51 are held in a die case 62 at given spaces in a line as mentioned above, the eccentricity of the forming slots 59 becomes great so that flexure of the die case 62 and the die assemblies 51 yielded by extrusion pressure is apt to cause forming slots 59 of each die assembly 51 to get warped. The problem that tubular elements 'E' will not precisely be extruded in points of size and shape may possibly be arisen.

OBJECT OF THE INVENTION

An object of the present invention is to provide a die assembly of a compact structure adapted for simultaneously extruding two or more hollow metallic articles of a high precision in size and shape in view of the above conventional problems.

Other objects and advantages of the present invention will become apparent from the description contained herein. It should be recognized that the examples are to describe preferable embodiments of the present invention. Accordingly, the invention is not limited to the examples and various modifications are possible within the spirit and the scope of the invention claimed.

SUMMARY OF THE INVENTION

In order to solve the above problems, a die assembly for simultaneously extruding a plurality of hollow metallic articles comprises a male die and a female die, wherein the male die comprises: a plurality of cores each having a bearing lug at its end to define a hollow space through a hollow article extruded by the die assembly; a core holder holding the cores therein and consisting of an annular portion and a bridge formed integrally with the annular portion, with the bridge extending across the annular portion; a plurality of apertures penetrating the bridge between an upstream and downstream ends of the bridge; the cores respectively inserted in each aperture, with the bearing lug protruding over the bridge, and wherein the female die comprises a plurality of bearing edges to contour a periphery of the hollow article, and the male and female dies are combined together to form a plurality of slots independently of each other surrounded by the bearing lug of the male die and the bearing edges of the female die.

In other words, the male die has a plurality of apertures at the bridge of the core holder and holds a plurality of the cores respectively inserted in the apertures. The female die provides a plurality of the bearing edges to contour a periphery of the hollow articles. The male die and the female die are combined to provide a die assembly, and a plurality of slots independently of each other are formed in the assembly. Due to such structure, one die assembly can extrude a plurality of hollow articles. Thus, in contrast to the simultaneous extrusion in which a plurality of die assembles are placed in a single die case, the die assembly of the present invention achieves simultaneous extrusion of hollow articles at fairly compact structure.

Furthermore, since the die assembly consists of the female die having a plurality of the bearing edges with the male die holding a plurality of the core in the bridge of the male die, the distance of each slot can be arranged close together. Therefore, it is possible to put each slot close to the center of the die assembly so that each hollow article is extruded in the exact size and the precise shape.

In this case, the annular portion of the core holder may preferably be a thick cylindrical member and the bridge portion may preferably be formed integrally with the thick cylindrical member at an upstream region of a cavity of the thick cylindrical member and the female die may preferably be fitted in the downstream region of the cavity of the thick cylindrical member.

DETAILED DESCRIPTION OF THE PREFERRED EMBODIMENTS

Now, some embodiments will be described referring to the accompanying drawings.

Figure 8:
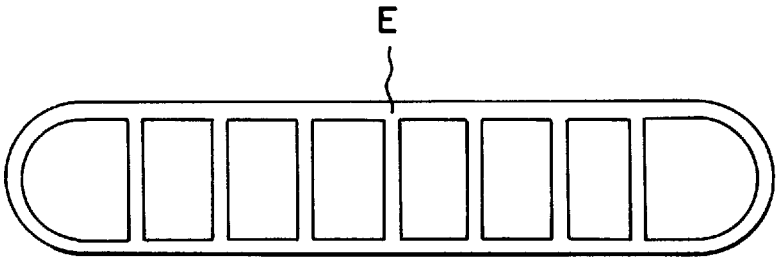
FIG. 8 PRIOR ART
FIG. 8 is an end elevation of a tubular element for a heat exchanger to be extruded.

Die assemblies provided herein may be used to extrude perforated flat tubular elements 'E' for a heat exchanger as shown in FIG. 8. However, the die assemblies can extrude any hollow articles in various shapes in transverse section other than such flat tubular element 'E'.

A die assembly 1 of a first embodiment shown in FIGS. 1A to 3 comprises a male die 2 and a female die 3. A flow regulating piece 4 is designed to regulate the flow of a material introduced into the die assembly 1 to be extruded therethrough.

The male die 2 comprises cores 5, a core holder 6 and core supporting pieces 7.

There are two (or more) cores 5 in the die assembly of this embodiment. Each core 5 is made of a hard material such as cemented carbide and is a rectangular member in the shape of a flat plate having laterally narrow region. The forward (downstream) end of each core 5 has a bearing lug 9 to define a hollow space through a hollow article 'E' extruded by the die assembly 1. A round hole 10 is vertically penetrated through a middle portion of the core, at a wider region behind the forming lug 9. Each core 5 has its upstream region 11 tapered in width towards the rearward (upstream) end.

Figure 1B:
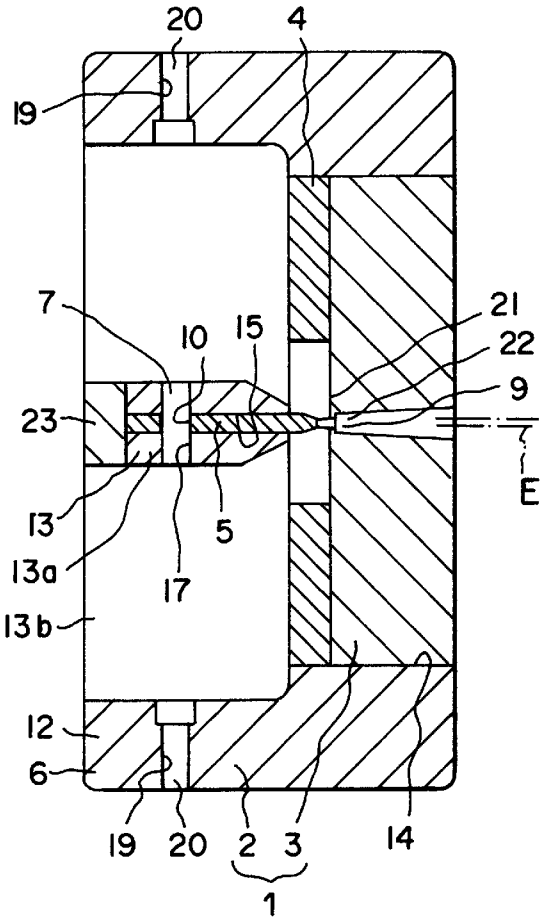
FIG. 1B is a cross section taken along the line 1—1 in FIG. 1A.
Figure 1A:
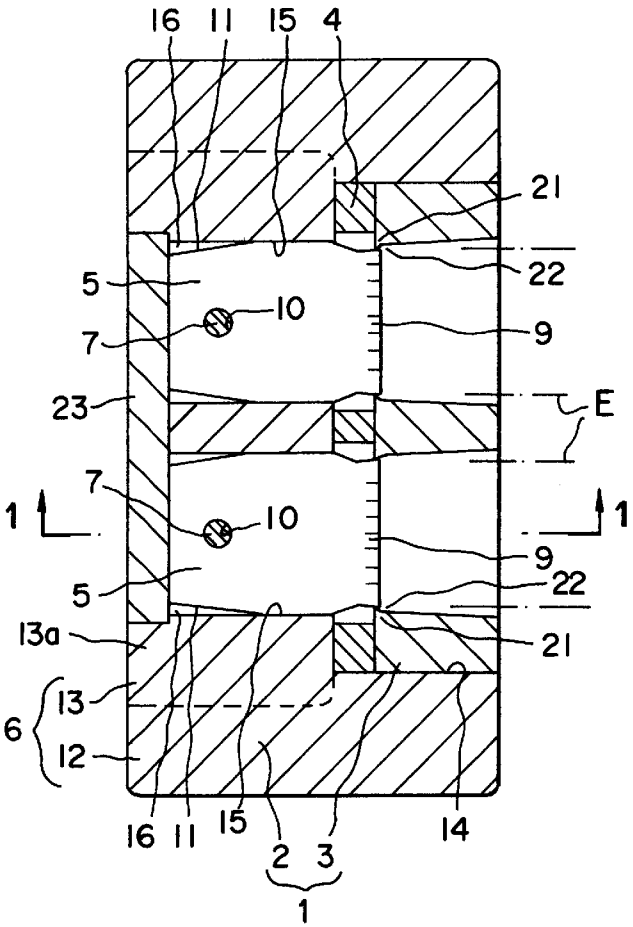
FIG. 1A is a horizontal section of a die assembly according to a first embodiment of the invention.
Figure 2:
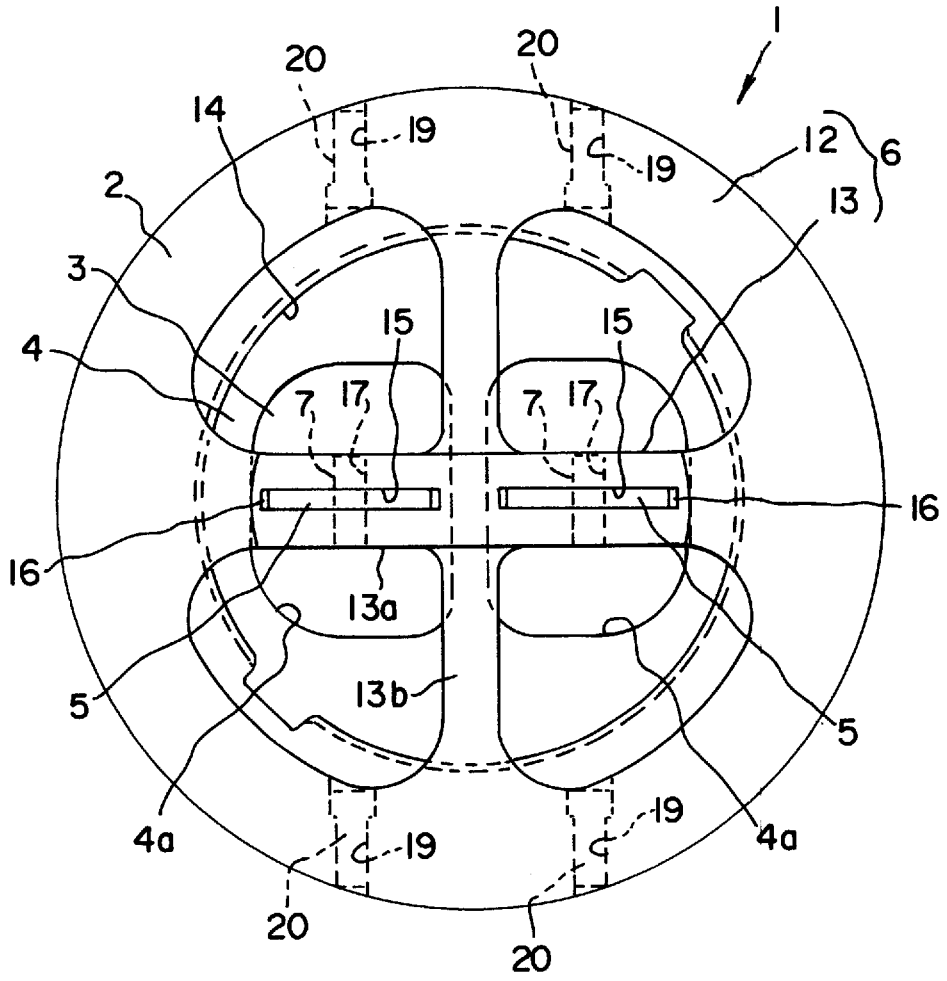
FIG. 2 is a rear end view of the die assembly.
Figure 3:
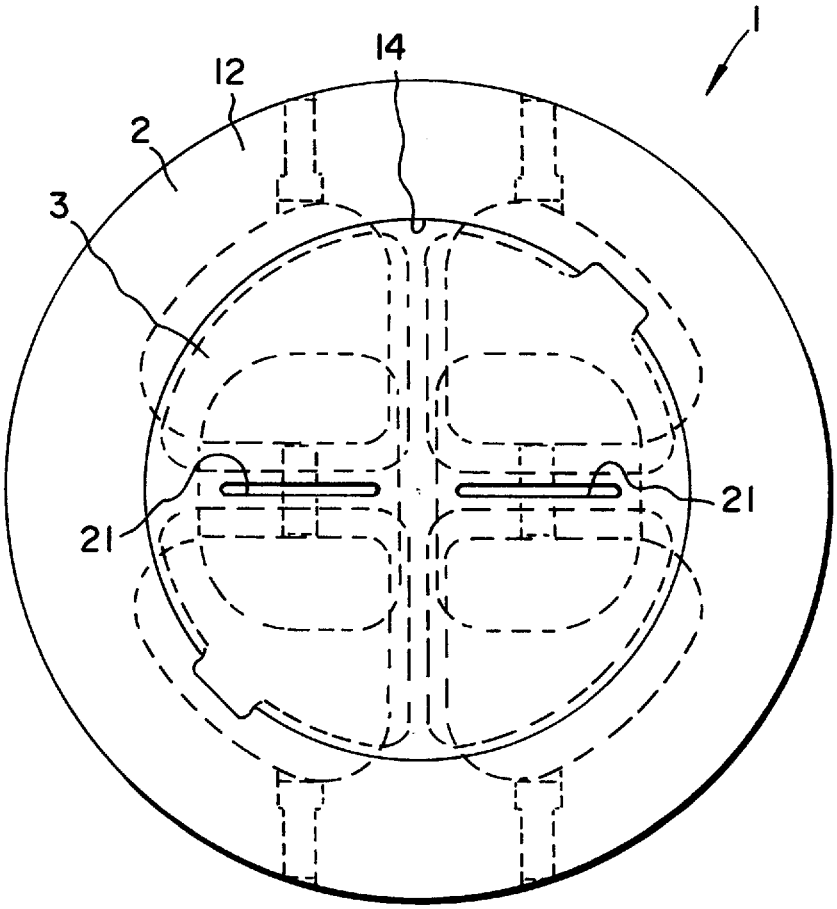
FIG. 3 is a front end view of the die assembly.

While a die assembly 1 comprises two cores 5 as mentioned above, the assembly comprises just one core holder 6, which is made of die steel. The numeral 12 denotes a thick cylindrical member in annular shape and the numeral 13 denotes a bridge. The bridge 13 is disposed at the upstream region of a cavity defined by the cylindrical member 12 with respect to the direction of extrusion. The bridge 13 is provided integrally with the cylindrical member 12 and extends crosswise over the cavity as seen in FIG. 2. The downstream region of the cavity in said cylindrical member 12 is a receiving portion 14 receiving and disposing the female die 3 and the flow regulating piece 4 therein.

As mentioned above, the bridge 13 extends crosswise over the thick cylindrical member 12, in detail, the bridge 13 comprises a thick main bridge 13*a* extending laterally and a relatively thin auxiliary bridge 13*b* extending vertically, which are intersecting integrally with each other.

Two apertures 15 for holding the cores 5 penetrate the main bridge 13*a* in the direction of extrusion, each aperture 15 being symmetrically spaced from the center of the die assembly.

The shape of aperture 15 is flat in transverse section corresponding to that of the core 5 so as to tightly fit the core. In the condition of the core 5 inserted in the aperture 15, clearances 16 for absorbing deformation are provided between the core 5 and the inside of the aperture 15 by the both sides of the tapered region 11 of the core 5. The size and shape of the tapered region 11 are designed to allow the inside of the aperture 15 opposed to the tapered region 11 to bear the tapered region 11 of the core 5 in order to prevent unsteadiness of the core 5 when the bridge 13 is deformed by extrusion pressure.

The main bridge 13*a* has round holes 17 penetrating through the bridge 13*a* and communicating with each aperture 15. The round holes 17 are located to put the auxiliary bridge 13*b* between the holes 17 and to correspond to the respective round holes 10 formed in each core 5. Each round hole 17 is formed corresponding to the size and shape of the round hole 10 for supporting the core 5 in cross section.

Tool insertion openings 19 penetrate the periphery of the wall of the thick cylindrical member 12 in coaxial alignment with the round holes 17 so as to correspond with the round holes 17. The tool insertion openings 19 are respectively provided in coaxial alignment with the round holes 17 at the wall of the cylindrical member 12 putting the main bridge 13*a* therebetween. The tool insertion openings 19 and the round holes 17 both defined in coaxial alignment are simultaneously opened by a wire cut device. The tool insertion openings 19 are formed not only for the purpose of cutting the round holes 17 by wire cut device, but also for fulfilling a very important function that, for example, in case of an exchange of an abraded core 5, a tool is inserted through the tool insertion opening 19, and the end of a core supporting piece 7 is thrusted thereby to detach the core supporting piece 7 so as to remove the core 5.

Each tool insertion opening 19 is closed by plugs 20. Each plug 20 and each tool insertion opening 19 respectively have shoulders to allow the plugs 20 to fit in the tool insertion openings 19 from the inside of the cavity of the thick cylindrical member 12 and to keep the plug 20 from slipping out thereby. Further, in the case of pulling up the plug 20, the plug 20 will be drawn into the cavity of the thick cylindrical member 12 by pushing the plug 20 from the outer periphery of the member 12. The plugs 20 are usually regulated to avoid slipping off by a caulking.

The core supporting pieces 7 are two in number corresponding to the number of cores 5 and respectively support each core 5. The core supporting pieces 7 are pin-shaped members of circular cross section made of a hard material such as cemented carbide, and the size of each pieces 7 corresponds to that of the round holes 10 of the cores 5 and the round holes 17 of the bridge 13 so that each pin is fitted in the holes 10 and 17. Each pin is of a length equal to or substantially equal to the thickness of the main bridge 13*a*.

The female die 3 is made of a hard material such as cemented carbide and has two flat bearing edges 21 that contour an outer periphery of a hollow article. The flow regulating piece 4 has two guide openings 4*a* corresponding to each bearing edge 21 of the female die 3.

To construct the die assembly 1, the flow regulating piece 4 and the female die 3 will be inserted into the thick cylindrical member 12 of the core holder 6 and the female die 3 is shrinkage-fitted in said cylindrical member 12 so as to be integral therewith. The two cores 5 will be respectively put into each aperture 15 of the bridge 13 from a rear end thereof causing the bearing lug 9 of each core 5 to protrude the predetermined length ahead from said bridge 13 and adapting the round holes 10 of each core 5 to correspond to the round holes 17 of the bridge 13. Subsequently, each core supporting piece 7 will be pushed sideways into the round holes 17, 10 and 17, 10 through the cavity of the cylindrical member 12. Both ends of core supporting pieces 7 will be caulked by a tool inserted through a tool insertion openings 19 so as to secure each core 5 to the bridge 13 by way of the core supporting pieces 7. All the openings 19 will be closed with the plugs 20. Thus, the end of the bearing lugs 9 of cores 5 are surrounded by the respective bearing edges 21 of the female die 3 and thereby independently to define two forming slots 22 corresponding to the cross-sectional shape of a hollow article 'E'. The reference numeral 23 denotes a lid.

Figure 4:
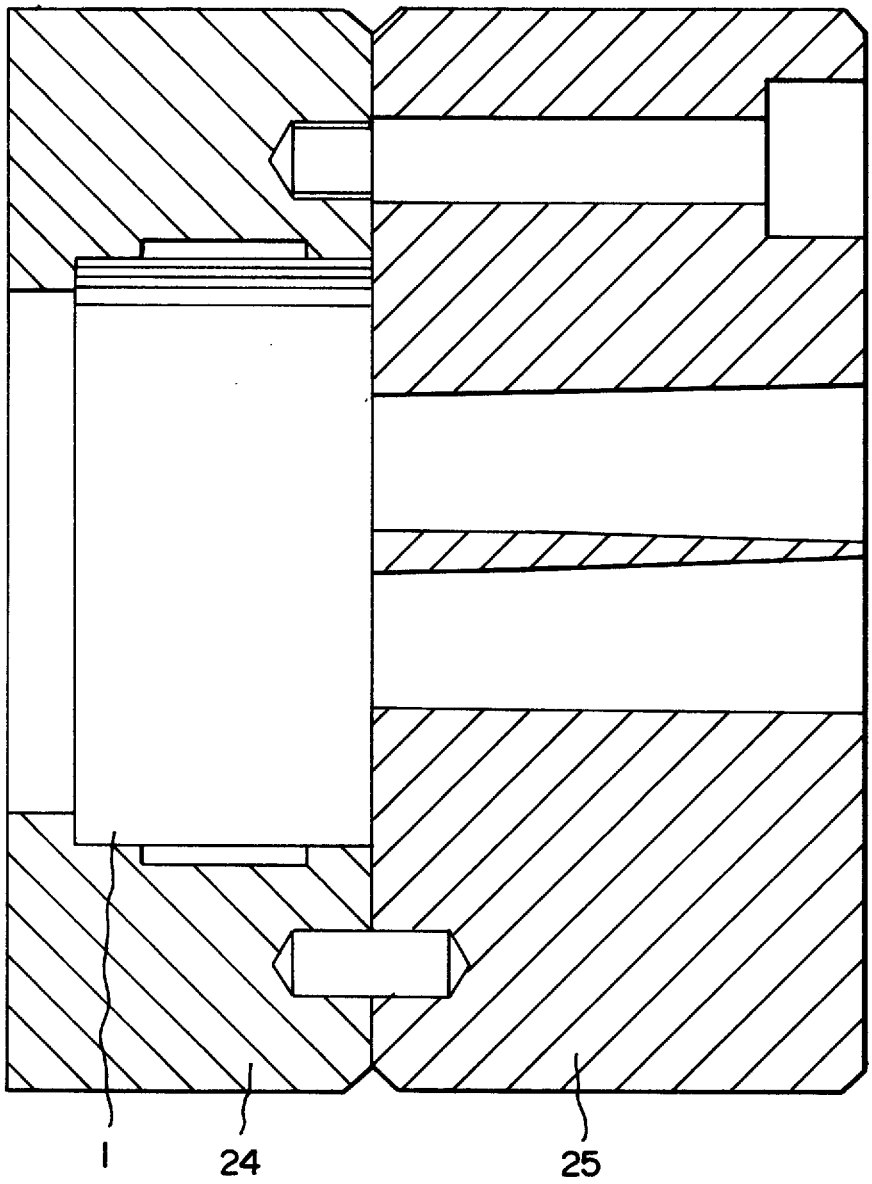
FIG. 4 is a vertical section of the die assembly shown in combination of a die case and a backup block.
Figure 5B:
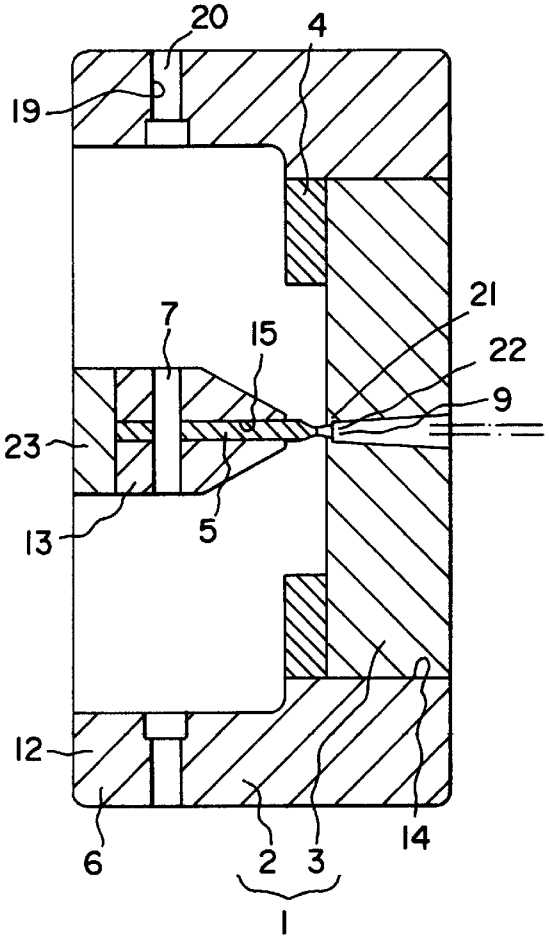
FIG. 5B is a cross section taken along the line 2—2 in FIG. 5A.
Figure 5A:
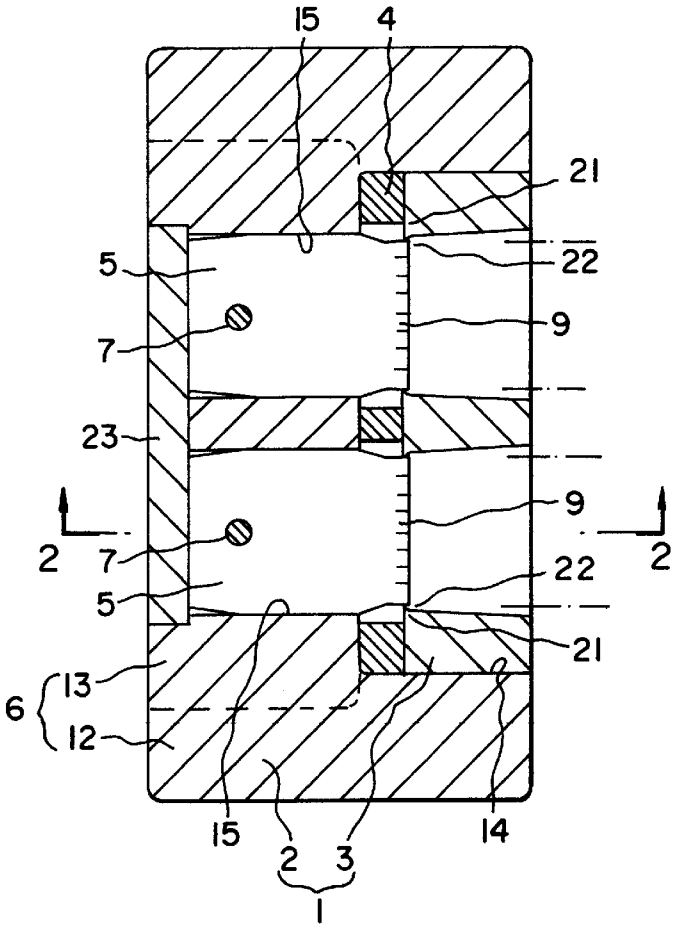
FIG. 5A is a horizontal section of a die assembly according to a second embodiment.
Figure 6:
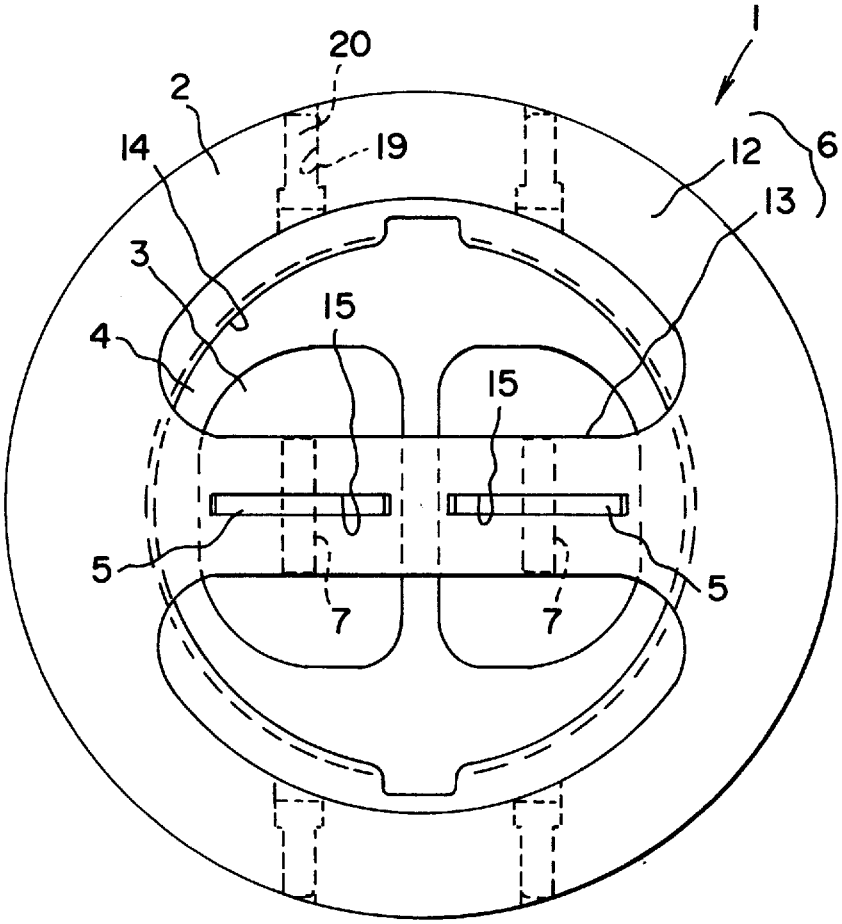
FIG. 6 is a rear end view of the die assembly.
Figure 7:
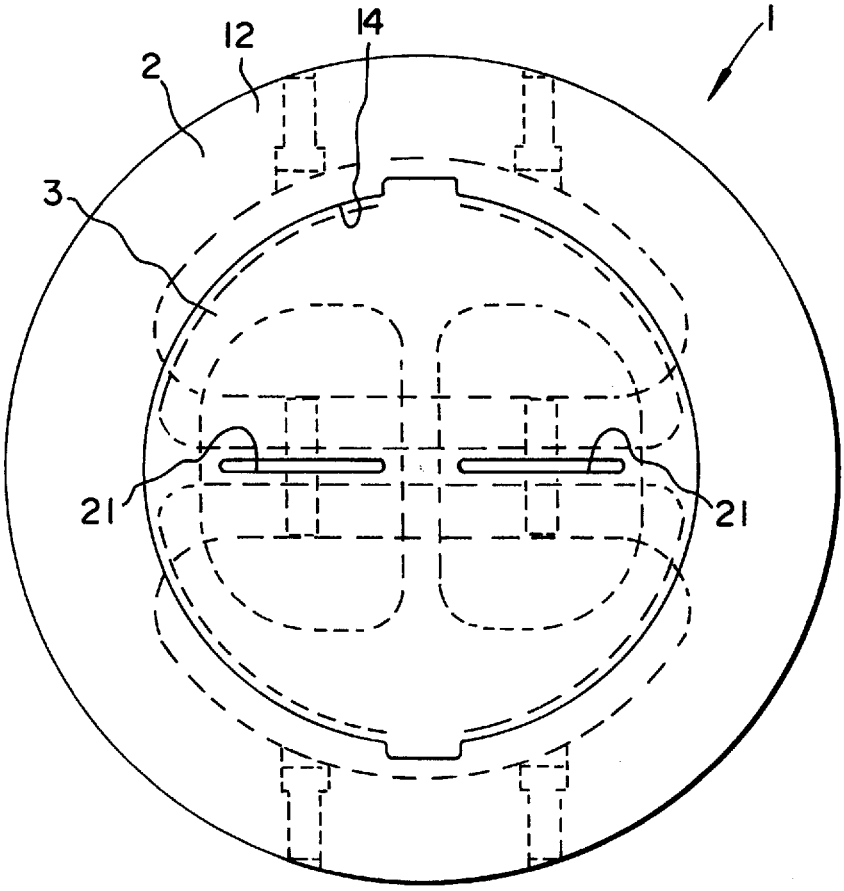
FIG. 7 is a front end view of the die assembly.
Figure 9:
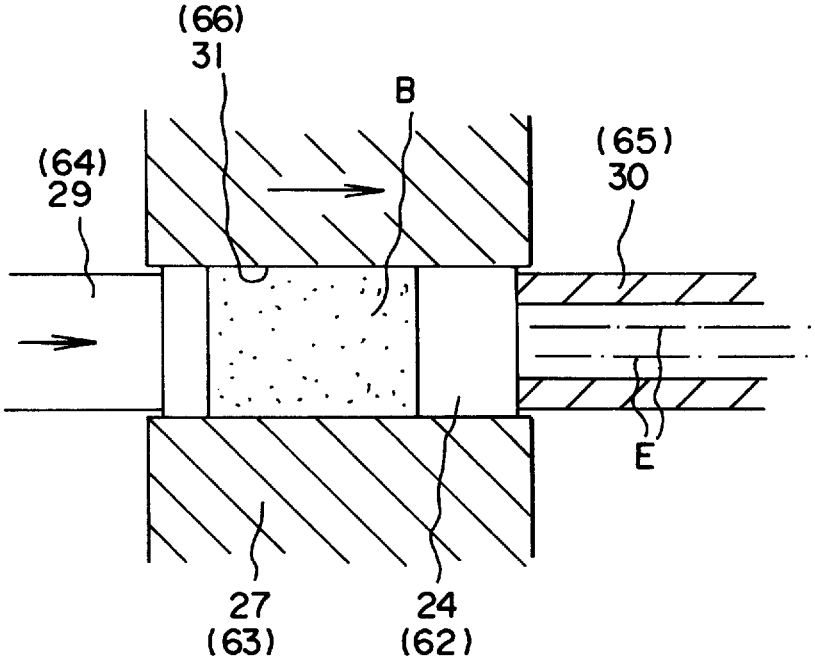
FIG. 9 PRIOR ART
FIG. 9 is a horizontal section of an indirect extruder.
Figure 10B:
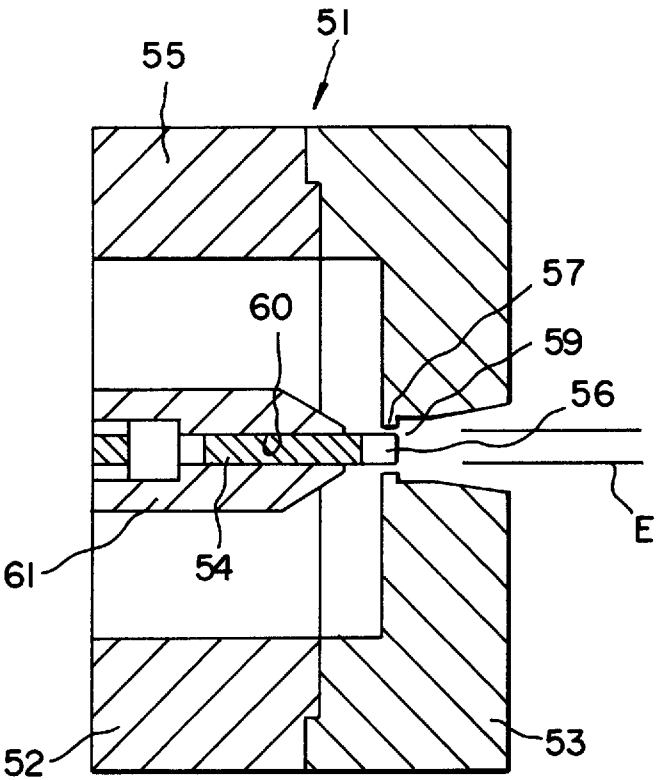
FIG. 10B PRIOR ART
FIG. 10B is a cross section taken along the line 3—3 in FIG. 10A.
Figure 10A:
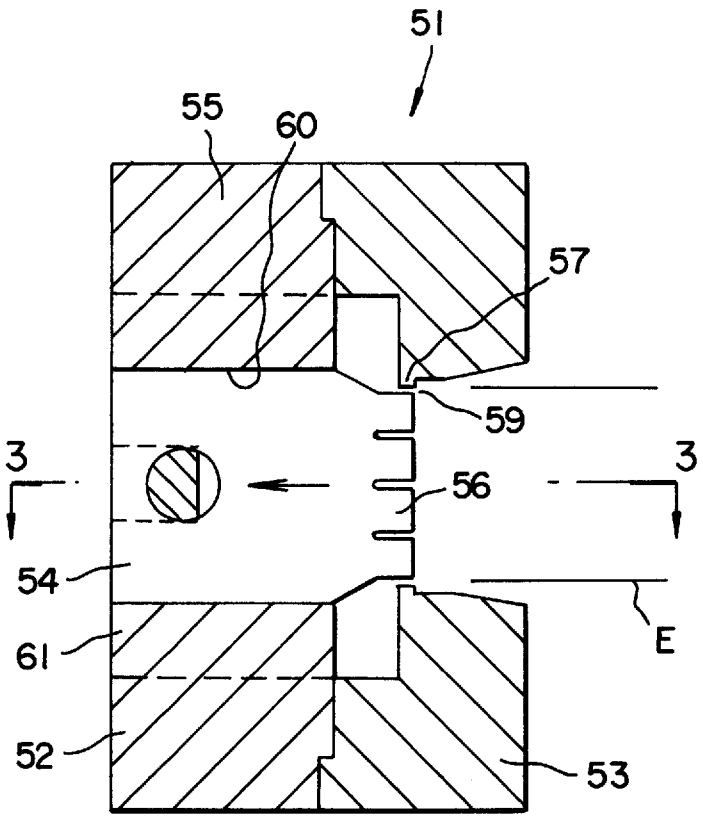
FIG. 10A PRIOR ART
FIG. 10A is a horizontal section of a conventional die assembly.
Figure 11:
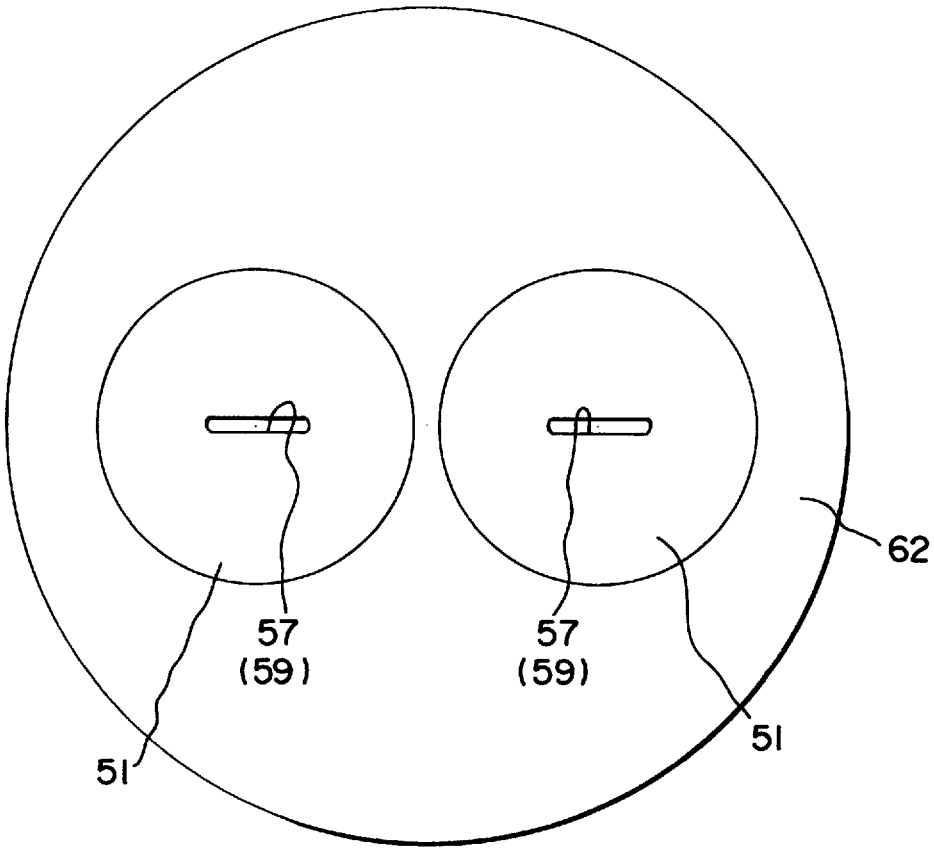
FIG. 11 is a front end view of the conventional dies in a die case.

The die assembly 1 described above may be placed in a die case 24 as occasion demands and combined with a backup block 25 shown in FIG. 4. This apparatus may be adapted for indirect extrusion as illustrated in FIG. 9. Referring to FIG. 9, the numerals 27, 29 and 30 respectively denote a container, a pressing stem and a die stem with the reference symbol 'B' denoting a billet.

Further, in the die assembly 1 described above, the male die 2 has two apertures 15 at the bridge 13 of the core holder 6 and holds two cores 5 respectively inserted in the aperture 15. Female die 3 provides two bearing edges 21 to contour an outer periphery of the hollow articles 'E'. The male and female dies are combined together so as to form a plurality of the forming slots 22 independently of each other. Therefore, in contrast to the conventional apparatuses in which a plurality of die assemblies corresponding to the numbers of hollow articles to be simultaneously extruded are held in one large die case, a single die assembly 1 of such a remarkably compact structure of the invention suffices to simultaneously extrude two elongate articles 'E'. Even if a die case 24 is used as is stated above, a whole die assembly 1 including the case 24 can now be rendered much smaller.

Moreover, in a case that the die assembly 1 is for indirect extrusion as mentioned above, it is possible to extrude a plurality of articles even by a container 27 having a small cavity for billets 31. Therefore, the size of a container 27 will no longer adversely affect the efficiency in simultaneously extruding a plurality of hollow articles.

Since a single bridge 13 in male die 2 holds two cores 5 and a female die 3 has a plurality of bearing edges 21, the forming slots 22 can now be arranged much closer to each other than in the conventional apparatuses. Accordingly, each forming slot 22 can be positioned sufficiently adjacent to the center of the die assembly without difficulty so as to be able to prevent the forming slots 22 from deformation caused by flexion of the die assembly 1 yielded by extrusion pressure. The hollow articles 'E' can be extruded with a high precision in size and shape.

The core holder 6 has a thick cylindrical member 12 and the bridge 13 is provided integrally with the thick cylindrical member 12 at the upstream region of the cavity of the cylindrical member 12 and the female die 3 is correspondingly fitted in the downstream region of the thick cylindrical member 12. The whole parts are integrated longitudinally. This feature enhances the rigidity of the whole die assembly 1 and the precision of the hollow articles 'E' will further by improved in size and shape and can be extruded at high speed and at high productivity.

Referring to the embodiment, since the bridge 13 is shaped cruciform to reinforce the main bridge 13*a* with the auxiliary bridge 13*b*, the rigidity of the bridge 13 is further improved so that the hollow articles 'E' will be extruded precisely in size and shape.

In a case that the die assembly 1 is filled with a material such as aluminum before extrusion thereof, little amount of extrusion material will suffice to fill up a small capacity of cavity in the thick cylindrical member 12. When filling of the extrusion material, just one die assembly 1 has to be heated, so that the thermal energy is reduced. Even if the extrusion material remains in the die assembly 1 after extrusion, the amount is small. Thus, the remains of the material can be removed economically and efficiently and also beneficially in environmental aspect.

In a second embodiment of a die assembly 1 shown in FIGS. 5A to 7, the bridge 13 is straight, that is, it does not comprise any auxiliary bridge. If the bridge 13 can keep sufficient strength and rigidity without an auxiliary bridge, it is not necessary to mount the auxiliary bridge as it is shown. This structure affords a beneficial effect that the flow resistance of the extrusion material within the die assembly 1 is reduced. Since the other features are the same as those in the first embodiment, the explanation will be omitted.

The foregoing embodiments are not confined to the details set forth and may be modified in various manners, and, for example, the die assembly can be designed to simultaneously extrude more than three or four hollow articles. In the above embodiments, the core 5 is supported in the core holder 6 by the supporting piece 7, but a core may be supported in a core holder by a shoulder formed integrally with the core, for example. The die assembly may be used not only in indirect extrusion by also in the direct extrusion of such hollow articles.

Based on the foregoing, in the die assembly of the present invention for extruding metallic hollow articles, the male die has a plurality of apertures at the bridge of the core holder and holds a plurality of the cores respectively inserted in the apertures. The female die provides a plurality of the bearing edges to contour outer peripheries of the hollow articles. The male and female dies are combined together so as to respectively form a plurality of the forming slots. Therefore, in contrast to the simultaneous extrusion by a die assembly in which a plurality of die assemblies have been placed in a single die case, the die assembly of the present invention can achieve simultaneous extrusion of hollow articles with a fairly compact structure.

In a case that the die assembly is used as indirect extrusion as mentioned above, it is possible to extrude a plurality of articles even by a container having a small cavity for billets. Therefore, the size of a container will no longer adversely affect the efficiency in simultaneously extruding a plurality of hollow articles.

Since a single bridge in male die holds two cores and a female die has a plurality of bearing edges, the forming slots can be arranged much closer to each other. Accordingly, each forming slot can be positioned sufficiently adjacent to the center of the die assembly without difficulty so as to be able to prevent the forming slots from deformation caused by flexure of the die assembly yielded by extrusion pressure. The die hollow articles can be extruded with a high precision in size and shape.

The core holder has a thick cylindrical member and the bridge portion is formed integrally with the thick cylindrical member at an upstream region of the cavity and the female die is correspondingly fitted in the front of the thick cylindrical member. This feature enhances the rigidity of the whole die assembly and the precision of the hollow articles will be further improved in size and shape.

What is claimed is:

1. A die assembly for simultaneously extruding a plurality of hollow metallic articles, the die assembly comprising:

a male die and a female die;

the male die comprising:

a plurality of cores each having a bearing lug at its end to define a hollow space through a hollow article extruded by the die assembly;

a core holder holding the cores therein and consisting of an annular portion and a bridge formed integrally with the annular portion, the annular portion of the core holder including a thick cylindrical member, and the bridge comprising a main bridge portion extending laterally across the annular portion and an auxiliary bridge extending vertically across the annular portion, the main bridge portion and the auxiliary bridge portion intersecting integrally with each other, the bridge formed with the cylindrical member at an upstream region of a cavity of the thick cylindrical member; and a plurality of apertures penetrating the main bridge portion in the direction of extrusion, the apertures being for holding the cores and are of a shape to tightly fit the cores, the cores respectively inserted and held in each aperture, with the bearing lug protruding over the main bridge portion, each core having an upstream region inwardly tapered in width toward the upstream end, so that clearances for absorbing deformation are provided between each side of the tapered region of the core and the inside wall of each aperture;

the female die comprising:

a plurality of bearing edges to contour a periphery of the hollow article, the female die is fitted in a downstream region of the cavity of the thick cylindrical member and the male and female dies are combined together to form a plurality of slots independently of each other surrounded by the bearing lug of the male die and the bearing edges of the female die, and a flow regulating piece in the cavity and between the male die and the female die.

2. A die assembly as defined in claim 1, wherein each core has a round hole that penetrates the core at the upstream of the bearing lug, the bridge has round holes that penetrate the bridge so as to cross the aperture for holding cores, the core inserted into the aperture of the bridge is held by pin-shaped supporting pieces inserted in the round hole of the core and the round hole of the bridge, and the die assembly further comprising tool insertion openings that penetrate both sides of the peripheral wall of the cylindrical member putting the bridge therebetween in coaxial alignment with the round hole of the bridge, wherein each tool insertion opening is detachably closed by a plug.

3. A die assembly as defined in claim 1, wherein the assembly is designed for use in the indirect extrusion of the hollow metallic articles.

* * * * *